US005369902A

United States Patent [19]

Minster

[11] Patent Number: 5,369,902

[45] Date of Patent: Dec. 6, 1994

[54] INTERCHANGEABLE SIGN SYSTEM

[75] Inventor: Richard W. Minster, Fairport, N.Y.

[73] Assignee: Precision Design Systems, Inc., Rochester, N.Y.

[21] Appl. No.: 127,235

[22] Filed: Sep. 27, 1993

[51] Int. Cl.[5] ..... G09F 23/00

[52] U.S. Cl. ..... 40/645; 248/156; 248/530; 248/205.3; 248/219.4; 156/306.6; 156/313

[58] Field of Search ..... 40/645, 606, 607; 248/156, 530, 121, 244.3, 205.3, 219.4; 156/306.6, 313; 403/205, 377, 382, 403

[56] References Cited

U.S. PATENT DOCUMENTS

| | | | |
|---|---|---|---|
| 1,769,430 | 7/1930 | Henke | 248/156 |
| 1,822,787 | 9/1931 | Slawson | 40/645 |
| 2,048,906 | 7/1936 | Webster | 40/645 |
| 2,765,998 | 10/1956 | Engert | 248/205.3 |
| 5,232,103 | 8/1993 | Koenig et al. | 248/205.3 |

FOREIGN PATENT DOCUMENTS

| | | | |
|---|---|---|---|
| 2600349 | 12/1987 | France | 40/606 |
| 8500236 | 1/1985 | WIPO | 40/606 |

*Primary Examiner*—Edward K. Look
*Assistant Examiner*—Christopher Verdier
*Attorney, Agent, or Firm*—Cumpston & Shaw

[57] ABSTRACT

An interchangeable sign system for locating indicia relative to a predetermined display includes an integral support member having a spacing portion and a retaining portion, and an indicia bearing member having a front indicia bearing surface and a flat rear surface including a retainer for freely, slidably engaging the indicia bearing member and the support member. The retaining portion and the spacing portion are not collinear but intersect at a junction to form an intersecting angle of between about 10 degrees to 170 degrees with respect to the spacing portion to orient the indicia bearing member in the line of sight of an observer when the indicia bearing member is above or below the observer's level line of sight. In the preferred embodiment, the retainer defines an open ended channel superbonded to the rear surface of the indicia bearing member. The channel has a cross sectional opening corresponding to the cross section of the retaining portion so that the indicia bearing member can be freely slid onto or off of the support member. The support member also has a pointed end for securing the sign system in the ground.

5 Claims, 2 Drawing Sheets

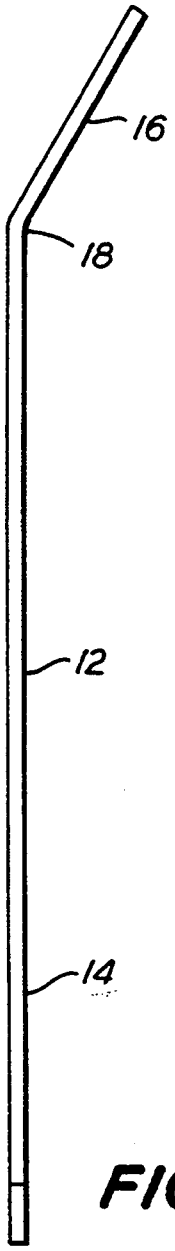
FIG. 2
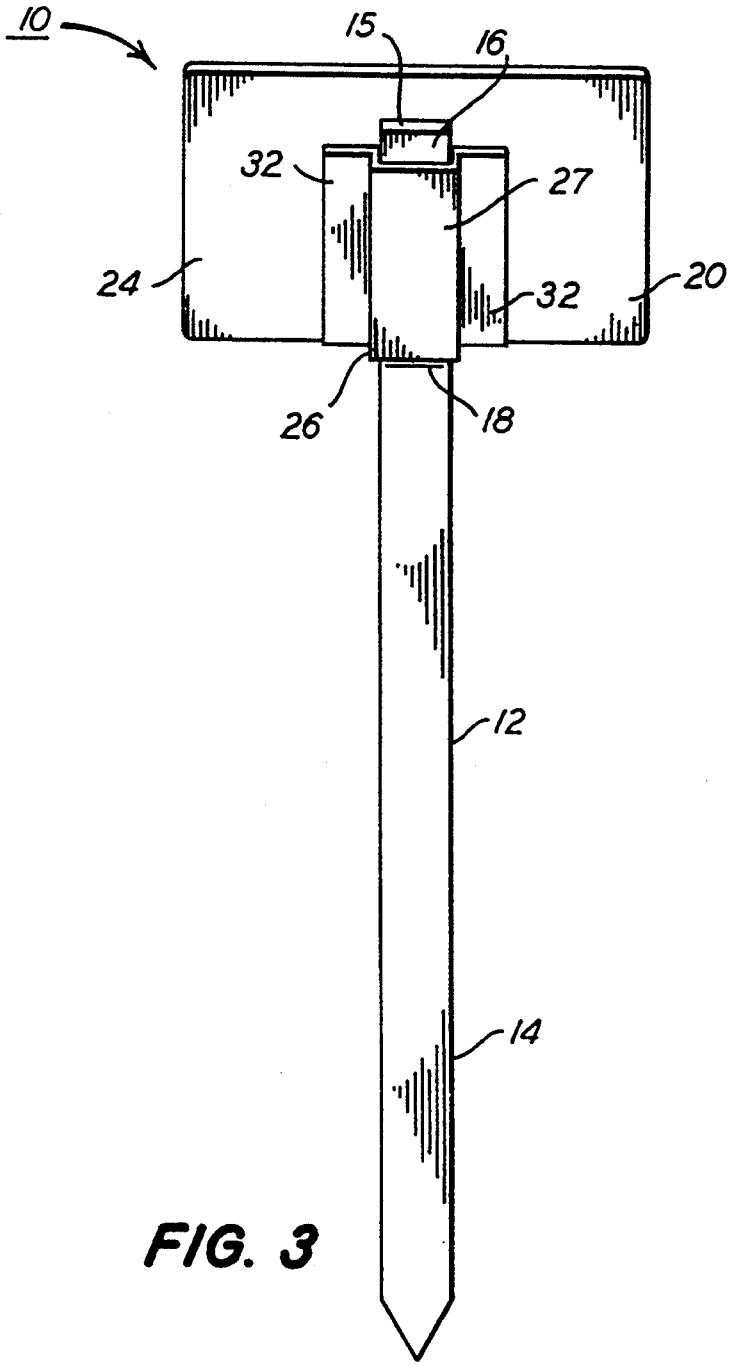
FIG. 3
FIG. 4
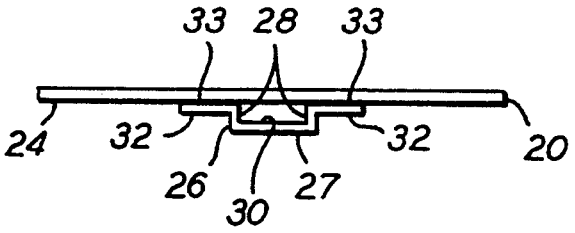

INTERCHANGEABLE SIGN SYSTEM

FIELD OF THE INVENTION

This invention relates generally to signs, and more particularly to an interchangeable sign system permitting convenient interchange of indicia bearing portions of the system.

BACKGROUND OF THE INVENTION

Signs are everywhere, and they provide a means for displaying information useful in an infinite variety of situations. Many environments in which signs are used, however, are inhospitable thus requiring periodic sign maintenance or total replacement for optimal effectiveness. In other instances, the changing nature of the subjects or objects to which the sign indicia applies necessitates periodic removal of misinformational signs and replacement with signs bearing the appropriate information. This may involve the dismantling of supports and enclosures which requires tools and extended labor, or require total replacement of an integral sign structure and the discarding of the old sign. Furthermore, the placement and position of signs significantly affects both the attractiveness of the sign and the willingness of viewers to regard the messages conveyed by the sign.

One particular sign environment requiring consideration of all of the above mentioned factors is that of a botanical garden. The majority of signs in a botanical garden will bear indicia about plants. Since the great majority of plants are rooted, their nature requires observers to look in a downward direction in order to view parts, if not all, of them. Thus, the height and orientation of the indicia bearing surface of the sign will influence an observer's willingness to regard the indicia along with the actual subject matter thereof. Of course, the attention to optimal height and orientation of signs is not limited to the case of downward viewing.

A botanical garden is also an environment infiltrated with abundant amounts of organic matter and other growing adjuncts, such as vermiculite, lime, fertilizers, and a variety of oil based herbicides, insecticides, and the like, which make for a dirty and greasy environment that is detrimental to the signs located therein.

Finally, due to the cyclic nature of plants, botanical displays are constantly changing, requiring corresponding sign replacement and storage of signs not in use. This can be environmentally taxing and require excessive space, respectively.

Accordingly, there is a need for an interchangeable sign system for use in environments conducive to sign deterioration, and having changing subject applications and particular viewing requirements, such as are typically found in botanical gardens, for example, that permits easy removal of the informational section of the sign and likewise easy replacement without requiring handling of unwieldy stake portions of varying lengths, and also that promotes environmental conservation and savings in cost and storage space.

SUMMARY OF THE INVENTION

The invention describes an interchangeable sign system for locating indicia relative to a predetermined display, comprising:

a support member;

an indicia bearing member having a front surface and a rear surface releasably supportable by the support member; and a retainer for freely, releasably engaging the indicia bearing member and the support member attached to the indicia bearing member.

In a preferred embodiment of the invention for use in a botanical garden setting, or the like, where the viewable subject matter is often below eye level of an ordinary observer, the support member integrally includes a spacing portion and a retaining portion in which the retaining portion is not collinear with the spacing portion, but rather forms a fixed angle with respect to the spacing portion of between about 10° to 170°. At the obtuse range of angles, when the support member is stuck into the ground and the indicia beating member is joined to the retaining portion of the support member, the surface of the indicia bearing member will be more directly in the line of sight of an observer who is glancing downwards to view the sign information and the accompanying subject matter. For this type of use, the end of the spacing portion opposite the junction with the retaining portion will be pointed or tapered to facilitate sticking the supporting member into the ground. When the retaining portion of the support member intersects the spacing portion in the acute range of angles, an indicia bearing portion of the sign will be more directly in line with the viewer's line of sight of the support member is attached to or extends from a vertical wall surface.

The retainer may be of various forms and should permit easy removal and replacement of the indicia bearing member on the retaining portion of the support member. The retainer can include brackets, rings, bendable or resilient fingers, or a channel having a cross sectional area that is complimentary to the cross sectional area of the retaining portion of the support member, being either removably attached to, or integral with, the perimeter or the front or rear surface of the indicia bearing member.

Furthermore, in a preferred embodiment of the invention, the indicia bearing member is manufactured of anodized aluminum, such as is known to a person s killed in the art as metalphoto. A metalphoto indicia bearing member allows the surface of said member to be photosensitized to permit high fidelity reproduction of text, line drawings, and half tone photographs, which are sealed within the anodized layer of the front surface. Metalphoto is also impervious to acids, fungus, salt, spray, moisture, weathering and temperature extremes, and has a surface hardness identical to sapphire, while being as clear as glass. Printing of black indicia on a silver background or silver indicia on a black is possible.

The support member in the preferred embodiment of the invention has standard width and thickness dimensions on the order of 0.75″×0.125% respectively, which correspond to dimensions of the holding means such that a current indicia bearing member can be slideably removed from the retaining portion and any of a variety of different indicia bearing members can replace it. The length of the supporting member is typically about 18″, however, this may vary to accommodate the particular subject matter or a particular viewing direction.

Accordingly, it is an object of this invention to provide a sign system in which the location and orientation of the indicia bearing portion of the sign is particularly convenient for display below or above eye level of an ordinary observer.

It is another object of the invention to provide a sign system in which the indicia bearing portion of the sign can be easily removed from a support section for cleaning and thereafter easily replaced with a clean sign.

It is a further object of the invention to provide a sign system wherein the indicia bearing portion of the sign can be easily removed from a support section, and thereafter easily replaced with a different indicia bearing portion without the need for tools or adhesives of any sort.

It is a still further object of the invention to provide an interchangeable sign system that promotes conservation of resources including, but not limited to, sign system hardware and storage space.

These and other objects and advantages of the invention will be apparent upon viewing the illustrations and reading the description of the invention which follows.

BRIEF DESCRIPTION OF THE DRAWINGS

FIG. 2 is a side elevational view of the support member of the preferred embodiment of the invention showing the pointed spacing portion and the angled retaining portion;

FIG. 3 is a rear elevational view of the preferred embodiment of the invention showing the indicia bearing member having a channel structure holding, means engaged with the retaining portion of the support member; and FIG. 4 is a top elevational view of the preferred embodiment of the indicia bearing member of the interchangeable sign system showing the channel structure holding means affixed to the rear surface of the indicia bearing member.

DETAILED DESCRIPTION OF THE PREFERRED EMBODIMENT

Figure 1:
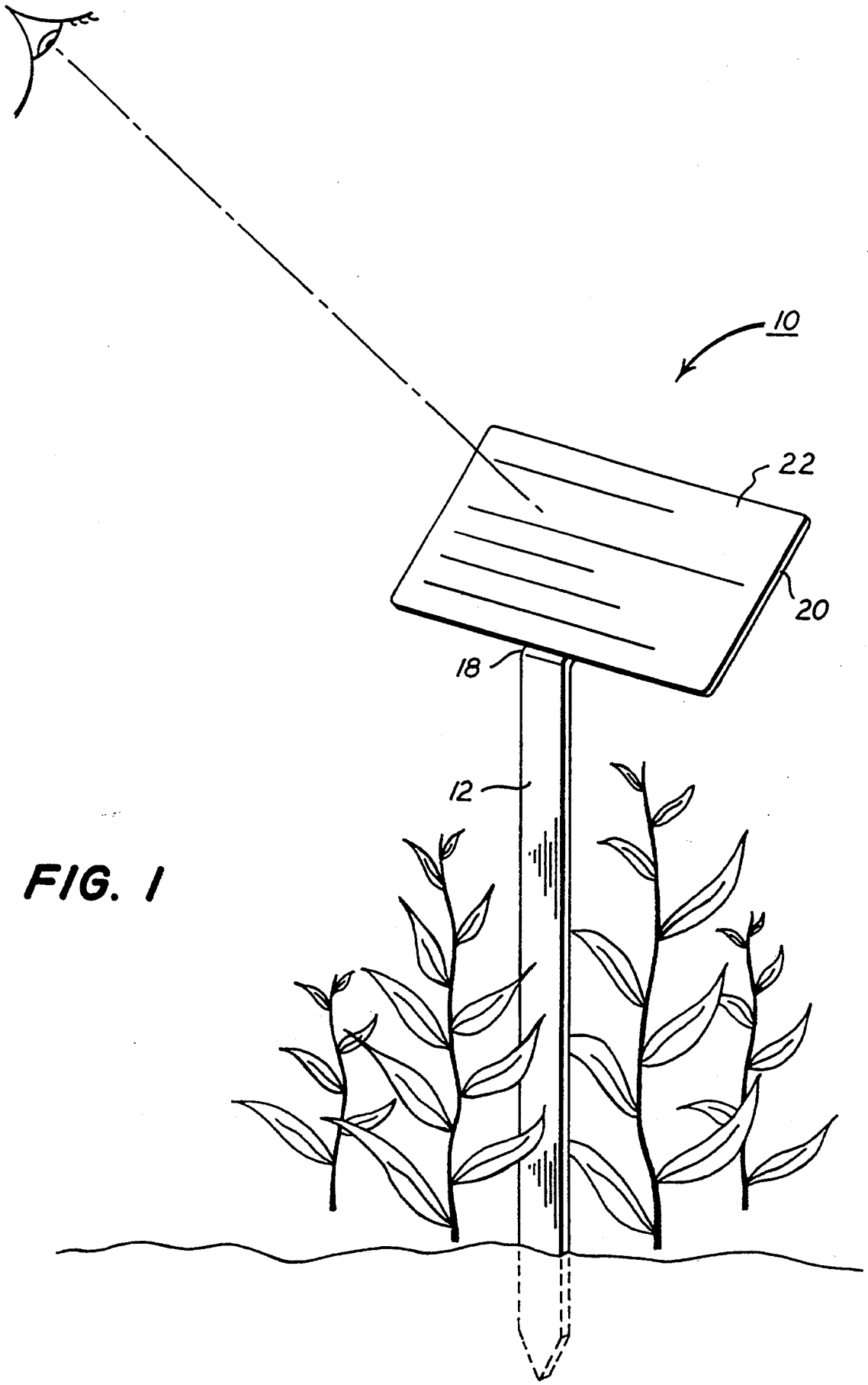
FIG. 1 is a perspective schematic view of the preferred embodiment of the interchangeable sign system of the invention showing the sign system stuck into the ground in a botanical setting.

FIGS. 1-4, in which like reference numerals represent like parts through the several views, illustrate an interchangeable sign system 10 for locating indicia relative to a predetermined display below eye level of a typical observer. The interchangeable sign system comprises an integral support member 12 including a spacing portion 14 and a retaining portion 16. The support member 12 as shown in FIG. 3 has a rectangular cross section 15, the significance of which will become apparent shortly. The spacing portion 14 and retaining portion 16 are not collinear, but intersect at a junction 18 to form an angle between approximately 10° and 170° and preferably at about 140°, as shown in FIG. 2, with respect to the spacing portion 14. As will be described in more detail below, the junction limits the distance over which the sign engages the support member to substantially the length of the retaining portion.

The interchangeable sign system 10 further comprises an indicia carrying member ("sign") 20 having an indicia bearing front surface 22 and a flat rear surface 24. The sign 20 is freely, removeably engaged by the support member by means of a retainer 26 described below.

As shown in FIGS. 3 and 4, a retainer 26 includes a back wall 27 and two side walls 28 which define an open-ended channel 30, and two wing sections 32 each depending perpendicularly outward from side walls 28. The retainer 26 is affixed to the flat rear surface 24 of the sign 20 whereupon, as shown in FIG. 4, a rectangular cross sectional opening exists throughout the length of the retainer. In a preferred embodiment, the retainer is superbonded to the rear surface 24 of sign 20 using a superbonding adhesive 33, such as, for example, 3-M Brand 4920D/C tape. This method of affixing the retainer to the sign requires neither tools nor mechanical attachment devices such as rivets or screws; is simple; and permanent.

As shown in FIGS. 3 and 4, the cross sectional opening between retainer channel 30 and sign rear surface 24 corresponds to the cross section 15 of support member 12 permitting the support member to slidably engage the channel 30 and thus freely retain the sign 20. Although the cross sectional dimension as shown is rectangular, it will be evident to one skilled in the art that the congruency of the cross sectional shapes of the support member and the channel is more pertinent than the particular cross sectional shapes selected.

The angle at which the retaining portion 16 intersects the spacing portion 14 of support member 12 provides a surface area immediately adjacent junction 18 which acts to limit the distance that sign 20 can slide down support member 12 to substantially the length of the retaining portion 16 when the retaining portion slides through the channel 30.

The end of spacing portion 14 opposite junction 18 is pointed, as shown in FIGS. 2 and 3, to permit the support member 12 to penetrate and be secured in an earthen environment, as shown schematically in FIG. 1.

It will be obvious to a person skilled in the art that the description of the invention appearing above is merely exemplary of the preferred embodiment of the invention, and that changes and modifications to the invention are possible without departing from the scope of the invention as it is fully set forth in the appended claims.

What is claimed is:

1. An interchangeable sign system for locating indicia relative to a predetermined display, comprising:

an indicia bearing member including a front surface including the indicia and a flat rear surface;

a retainer having an open-ended channel defined by a back wall and two side walls, and two flat wing sections each depending perpendicularly outward from the side walls in which a two-sided adhesive is bonded to the wings for affixing the retainer to the flat rear surface;

an integral support member including a linear spacing portion and a linear retaining portion, in which the retaining portion and the spacing portion are not collinear so as to form a fixed intersecting angle at their junction, the support member having a cross section corresponding to the channel for freely, slideably engaging the indicia bearing member, whereby the junction precludes the retaining portion from engaging the indicia bearing member for more than a predetermined distance along the support member.

2. The interchangeable sign system of claim 1 in which the support member has at least one pointed end for penetrating an earthen environment.

3. The interchangeable sign system of claim 1 in which the intersecting angle is between about 10 degrees to 170 degrees with respect to the spacing portion.

4. The interchangeable sign system of claim 1 in which the intersecting angle is preferably about 140 degrees.

5. A method for fabricating an interchangeable sign system, comprising the steps of:

providing an indicia bearing member having at least one flat non-indicia bearing surface;

providing a retainer including a back wall and two side walls defining a channel, and two flat wing sections each depending perpendicularly outward from the side walls;

applying a two-sided superbonding adhesive to the wing sections;

superbonding the retainer to the at least one flat surface of the indicia bearing member;

providing a support member having a retaining portion and a spacing portion, wherein the retaining portion angularly intersects the spacing portion at a junction, and in which the retaining portion has a cross section corresponding to the channel for freely, slideably engaging the indicia bearing member.

* * * * *